US006997014B2

(12) United States Patent
Starcke et al.

(10) Patent No.: US 6,997,014 B2
(45) Date of Patent: Feb. 14, 2006

(54) COATINGS FOR GEMSTONES AND OTHER DECORATIVE OBJECTS

(75) Inventors: Steven F. Starcke, Rochester, MN (US); Ronald H. Kearnes, Rochester, MN (US); Keven E. Bennet, Rochester, MN (US)

(73) Assignee: Azotic Coating Technology, Inc., Rochester, MN (US)

( * ) Notice: Subject to any disclaimer, the term of this patent is extended or adjusted under 35 U.S.C. 154(b) by 0 days.

(21) Appl. No.: 10/288,401

(22) Filed: Nov. 4, 2002

(65) Prior Publication Data

US 2004/0083759 A1 May 6, 2004

(51) Int. Cl.
*A44C 17/00* (2006.01)

(52) U.S. Cl. ..... 63/32; 428/15

(58) Field of Classification Search ..... 63/32, 63/34; 428/15

See application file for complete search history.

(56) References Cited

U.S. PATENT DOCUMENTS

| | | | | | |
|---|---|---|---|---|---|
| 2,690,630 | A | * | 10/1954 | Eversole | 427/215 |
| 2,901,379 | A | | 8/1959 | Shannon | |
| 3,039,280 | A | * | 6/1962 | Flad | 63/32 |
| 3,306,768 | A | | 2/1967 | Peterson | |
| 3,468,646 | A | | 9/1969 | Finn | |
| 3,490,250 | A | * | 1/1970 | Jones | 63/32 |
| 3,508,894 | A | | 4/1970 | Torok | |
| 3,514,320 | A | | 5/1970 | Vaughan | |
| 3,539,379 | A | * | 11/1970 | Mayer | 427/255.19 |
| 3,552,352 | A | | 1/1971 | McConnel | |
| 3,665,729 | A | * | 5/1972 | Elbe | 63/32 |
| 3,711,322 | A | | 1/1973 | Kushihashi | |
| 3,837,884 | A | | 9/1974 | Rheinberger | |
| 3,848,876 | A | * | 11/1974 | Joschko et al. | 369/173 |
| 3,897,529 | A | * | 7/1975 | Carr et al. | 501/86 |
| 3,950,596 | A | * | 4/1976 | Carr et al. | 428/700 |
| 4,030,317 | A | * | 6/1977 | Rogell | 63/32 |
| 4,039,726 | A | * | 8/1977 | Carr et al. | 428/700 |
| 4,353,765 | A | * | 10/1982 | Covi et al. | 156/212 |
| 4,425,769 | A | * | 1/1984 | Hakoune | 63/32 |
| 4,490,440 | A | * | 12/1984 | Reber | 428/620 |
| 4,604,876 | A | * | 8/1986 | Hoffmann | 63/32 |
| 4,793,864 | A | | 12/1988 | Neumiller et al. | |
| 4,809,417 | A | * | 3/1989 | Normann, Jr. | 29/896.41 |
| 4,835,023 | A | * | 5/1989 | Taniguchi et al. | 428/15 |
| 4,942,744 | A | * | 7/1990 | Wei | 63/26 |
| 5,054,902 | A | * | 10/1991 | King | 351/44 |
| 5,235,462 | A | | 8/1993 | Bidermann | |
| 5,427,826 | A | | 6/1995 | Iida | |
| 5,605,759 | A | | 2/1997 | Prince et al. | |
| 5,853,826 | A | * | 12/1998 | Starcke et al. | 428/15 |

(Continued)

OTHER PUBLICATIONS

Hadley, Wayne Aqua Aura: "A Revolutionary Enhancing Process Turns Quartz into a Rainbow" *Rock and Gem* (May 1989).

(Continued)

*Primary Examiner*—Jack W. Lavinder
(74) *Attorney, Agent, or Firm*—Fredrikson & Byron, PA

(57) ABSTRACT

The invention provides a decorative object comprising a transparent or translucent substrate having a body and at least one surface bearing a thin film coating. The coating imparts in the substrate a body color that appears substantially constant at different angles of observation. This body color is imparted in the substrate at least in part by absorption of visible radiation that is transmitted through said coating. The coating includes a high absorption layer comprising film that is highly absorptive of visible radiation. Also provided are methods of coating gems and other decorative objects, as well as methods of heat treating coated gems and other decorative objects.

5 Claims, 7 Drawing Sheets

U.S. PATENT DOCUMENTS

| | | | | |
|---|---|---|---|---|
| 5,882,786 | A | 3/1999 | Nassau et al. | |
| 5,888,918 | A | 3/1999 | Pollack | |
| 6,000,240 | A | 12/1999 | Noda | |
| 6,146,723 | A * | 11/2000 | Arends | 428/15 |
| 6,197,428 | B1 * | 3/2001 | Rogers | 428/446 |
| 6,376,031 | B1 * | 4/2002 | Pollak | 428/15 |
| 2003/0008077 | A1 * | 1/2003 | Gupta et al. | 427/376.2 |

OTHER PUBLICATIONS

McKnight, William "Record and Disclosure of Invention for Supernatural Conductive Quartz" (Mar. 3, 1998).

Starcke, Affidavit of Steven F. Starcke, Sep. 8, 2005, 2 pages.

* cited by examiner

COATINGS FOR GEMSTONES AND OTHER DECORATIVE OBJECTS

FIELD OF THE INVENTION

The invention provides coatings for gemstones and other decorative objects. More particularly, this invention provides coatings that impart desirable color in gemstones and other decorative objects. The invention also provides methods for producing (e.g., depositing) coatings of this nature, methods of heat treating coated gemstones and other coated decorative objects to enhance color, as well as gemstones and other decorative objects carrying these coatings.

BACKGROUND OF THE INVENTION

The invention relates to methods of altering the appearance of decorative objects, such as gemstones, by coating the decorative objects with thin film coatings that provide color via optical absorption to improve the appearance of the objects.

A number of processes have been developed to improve the appearance of gemstones or to create simulated gemstones. For example, methods of diffusing ions into gemstones (e.g., diffusing ions of titanium and/or iron into sapphire, or diffusing ions of cobalt into topaz) have been disclosed. These diffusion methods, however, traditionally have been limited to specific ions and specific substrates. Moreover, diffusion methods typically involve extremely high temperature, which frequently causes breakage or damage of the gemstones. Diffusion methods characteristically cause the added ions to become part of the crystal surface with no distinct boundary. In fact, diffusion methods commonly leave a gradient of ion concentration in the substrate (e.g., in a gemstone). Diffusion methods typically require long processing times, commonly more than a day. Reference is made to U.S. Pat. Nos. 2,690,630 and 4,039,726.

Nuclear radiation has been used to produce color centers in gemstones, giving a body color that in some cases can be improved with heat treatment. Cyclotrons and neutron bombardment are routinely used to impart blue color in colorless topaz. This method does not involve coating the stone. Rather, it produces color centers throughout the stone. A disadvantage of this method is the requirement for a "cooling off" period to allow the topaz to radioactively decay to a safe level. Traditionally, it has only been possible to obtain shades of blue with this method. Impurities in the gemstone (and the nuclear process used) determine the particular shade of blue that is obtained. Thus, it is difficult to obtain a consistent color on any given lot of gemstones.

Rhinestones and Carnival Glass have reflective coatings layered on one or more surfaces of a clear substrate. The coating is usually silver or some other highly reflective material utilized to apply a mirror coating (usually silver or aluminum) onto the back (e.g., the pavilion) of a faceted glass gem. In such a coating, substantially all of the light is reflected without passing through the coating. U.S. Pat. No. 3,039,280 is representative.

Commonly-assigned U.S. Pat. No. 5,853,826, issued to Starcke et al., discloses desirable coatings for enhancing the optical properties of a decorative object, such as a gemstone. The coatings impart in the decorative object a desirable colored appearance, wherein the color of light reflected from the decorative object to a viewer changes with angle of observation.

Tavelite™ is a product produced by depositing thin multiple layers on a transparent substrate to produce an interference effect. The coating is believed to be deposited, at least in some cases, through a process that involves high temperatures. When gemstones are coated at high temperatures, considerable breakage can occur.

U.S. Pat. No. 6,197,428, issued to Rogers, assigned to Deposition Sciences, Inc., is believed to disclose the coatings and deposition methods that are used for some of the Tavelite™ products. The Rogers patent teaches an optical interference coating that is applied over substantially the entire surface of a gemstone. The coating comprises alternating layers of materials with relatively high and low refractive indices. The coating is said to be composed of materials that are substantially free of absorption of light (i.e., visible radiation). In particular, the optical interference coating is said to impart in the coated gemstone perceived color that is dependent on the angle of incidence and the relative positions of the object and the viewer.

Layered coatings on a surface of a gemstone have been provided to increase the "fire" of the stone. These techniques involve a first coating of a highly refractive material, with respect to the gemstone's index of refraction, followed by a second coating of a different highly refractive material. The layers are designed so that the light reflected at each interface of each layer causes an optical interference effect. Coatings of this nature are described, for example, in U.S. Pat. No. 3,490,250.

Aqua-aura™, a product of Vision Industries, is a surface treatment providing a single moderately saturated color. The surface treatment is proprietary, but is believed to involve a gold-based coating that is deposited by spraying at high temperatures. The Aqua-aura stones have a metallic sheen and a substantial dichroic appearance. For many applications, it is desirable to provide coated stones that do not have a dichroic appearance, as stones of this nature have a particularly natural appearance.

Atmospheric pressure chemical vapor deposition has been used to deposit films of titanium oxide by thermal decomposition of a titanium compound (usually $TiCl_4$) in air.

Colored lacquers have been painted onto the pavilion of gemstones to give the stones a colored appearance. Unfortunately, these lacquers tend to have poor durability, and have been found to come off easily.

It would be desirable to provide durable coatings that can be applied at low temperature to gemstones and other decorative objects to impart in the decorative objects a body color that appears substantially constant at different angles of observation.

SUMMARY OF THE INVENTION

Figure 1:
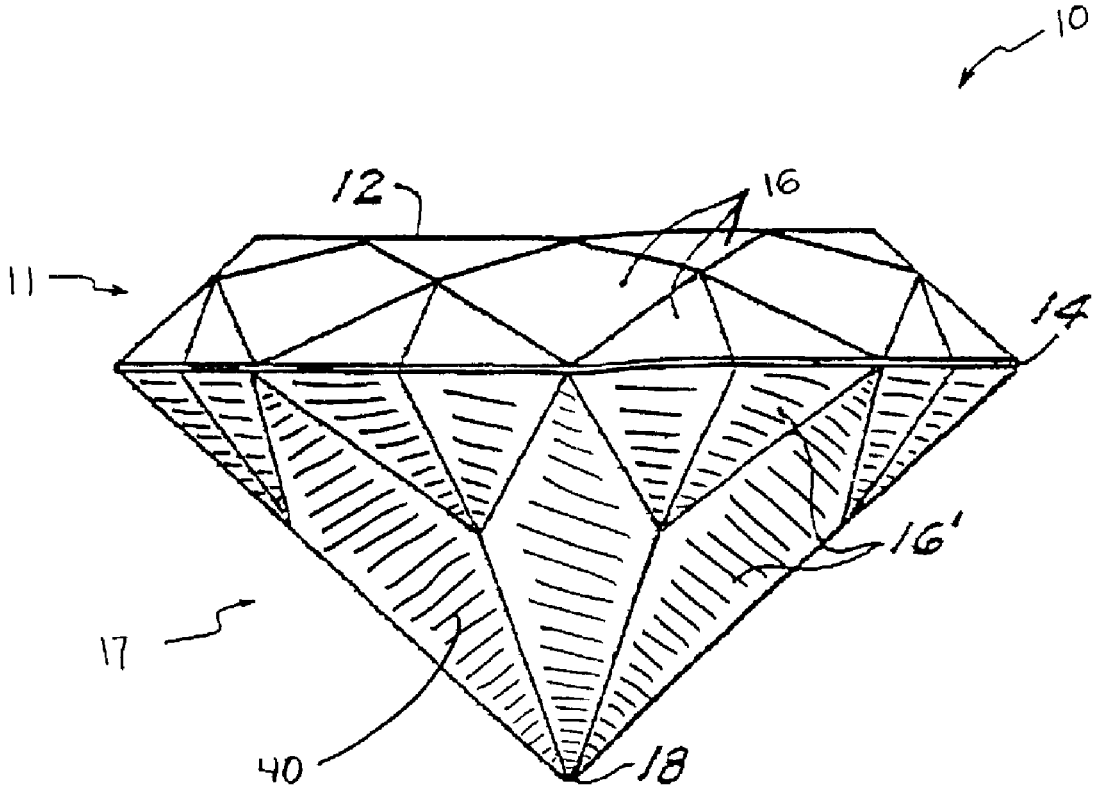
FIG. 1 is a side view of a gemstone carrying a coating on its pavilion in accordance with certain embodiments of the invention.

In certain embodiments, the invention provides a coated decorative object comprising a transparent or translucent substrate having a body and at least one surface bearing a sputtered coating that imparts in the substrate a desired body color that appears substantially constant at different angles of observation. The coating comprises a high absorption layer of film that is highly absorptive of visible radiation such that the desired body color is imparted in the substrate at least in part by absorption of visible radiation that is transmitted through the high absorption layer.

In certain embodiments, the invention provides a method for enhancing properties of a decorative object comprising a transparent or translucent substrate having a body and at least one surface. The method comprises coating the surface of the substrate, while maintaining the substrate at a low temperature of less than about 200 degrees Celsius, with a coating that imparts in the substrate a desired body color that appears substantially constant at different angles of observation. The coating comprises a high absorption layer of film that is highly absorptive of visible radiation such that the desired body color is imparted in the substrate at least in part by absorption of visible radiation that is transmitted through the high absorption layer.

In certain embodiments, the invention provides a method for enhancing properties of a decorative object comprising a transparent or translucent substrate. The method comprises coating a surface of the substrate while maintaining the substrate at a low temperature of less than about 200 degrees Celsius, and thereafter heat treating the coated substrate at an elevated temperature of greater than about 200 degrees Celsius but below that at which there occurs substantial diffusion of material from the coating into the substrate.

In certain embodiments, the invention provides a gemstone having a body and at least one surface bearing a sputtered coating that imparts in the gemstone a desired body color that appears substantially constant at different angles of observation. The coating comprises a high absorption layer of film that is highly absorptive of visible radiation such that the desired body color is imparted in the gemstone at least in part by absorption of visible radiation that is transmitted through the high absorption layer.

In certain embodiments, the invention provides a gemstone having a body with a pavilion bearing a coating that imparts in the gemstone a desired body color that appears substantially constant at different angles of observation. The coating is born only on the pavilion of the gemstone. The pavilion of the gemstone defines a culet and the coating has a thickness that is greatest adjacent the culet and becomes generally thinner with increasing distance from the culet. The coating includes a high absorption layer of film that is highly absorptive of visible radiation such that the desired body color is imparted in the gemstone at least in part by absorption of visible radiation that is transmitted through the high absorption layer.

In certain embodiments, the invention provides a method for enhancing properties of a gemstone. The method comprises sputter coating a surface of the gemstone while maintaining the gemstone at a low temperature of less than about 200 degrees Celsius, and thereafter heat treating the gemstone at an elevated temperature of greater than about 200 degrees Celsius but below that at which there occurs substantial diffusion of material from the coating into the gemstone.

In certain embodiments, the invention provides a method for enhancing properties of gemstones. The method comprises providing a coated gemstone having at least one surface bearing a coating, and heat treating the coated gemstone at an elevated temperature of greater than about 200 degrees Celsius but below that at which there occurs substantial diffusion of material from the coating into the gemstone.

DETAILED DESCRIPTION OF PREFERRED EMBODIMENTS

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

Various materials have inherent color and reflectivity/transmissivity properties that do not lend themselves well for use as decorative objects. Examples include such low cost transparent gem materials as colorless quartz ($SiO_2$), topaz ($AL_2SiO_4F_2$), and beryl ($AL_2Be_2Si_6O_{18}$). To enhance the decorative properties of such gem materials, pigments and dyes (colorant) have been used to provide colors in stones having cracks into which the colorant is made to penetrate. The colorant imparts a color change in the base gem material. The present invention teaches techniques that apply a thin (generally less than about 50,000 Å and preferably less than about 15,000 Å) coating 40 that does not materially change the dimensions, the structure, or the composition of the underlying substrate. The coating provides improved coloration pleasing to the eye of the observer.

The coating serves as an absorber of certain light frequencies to provide color. In certain embodiments, light entering the top (e.g., the crown, including the table) of a gemstone passes through the absorbing coating on the stone. This imparts color in the stone, thereby giving the stone a pleasing appearance and increasing the stone's value. In embodiments where the coating is applied by sputtering, the process is inexpensive and of high yield. Sputtered films provide excellent film qualities, such as desirable mechanical and chemical durability as well as desirable adhesion to the substrate. Coating durability is particularly important for coated gemstones and other decorative objects, as these objects are typically exposed to the ambient environment during use. Further, sputtering allows outstanding control over coating thickness, and sputtered coatings of highly uniform thickness can be deposited repeatedly and reproducibly. It is thus possible to obtain an exceptional degree of color uniformity for the individual stones, not only from a single batch, but also from different batches. In addition, sputtered coatings can provide thickness gradients on desired surfaces, etc., which gradients are difficult, if not impossible, to obtain using other deposition methods. When sputtered, the present coating 40 is preferably deposited while maintaining the substrate at a low temperature (i.e., less than 200 degrees Celsius) such that the coating 40 has a non-splotchy, uniform appearance. Coatings of this nature are especially advantageous.

In contrast, coatings applied by spray coating at high temperatures may have a splotchy, non-uniform appearance. It is postulated that this occurs when particles being sprayed pyrolize upon impacting the substrate. Thus, the present coating 40 is applied at a low temperature such that it 40 has a non-splotchy, uniform appearance. Further, when the thus coated decorative object is heat treated, as described below, the coated decorative object is given a surprisingly desirable color (e.g., a color that has a surprising hue and/or is surprisingly intense/has a surprisingly high chroma).

Thus, the invention relates to enhancing the appearance of gemstones and other decorative objects. The substrate can be formed of materials that are found naturally in the earth, or from synthetic materials (man-made materials, such as are made in a lab). The methods of the invention enhance the color and brilliance of decorative objects, such as faceted or cabochon cut stones, by the application of coatings having specific absorptive properties. In certain embodiments, the coating is applied only to the back (e.g., the pavilion) of a gemstone. The effect of the coating is to modify the intensity and color of the light reflected from the stone to the eye of the observer.

Thus, the invention provides a decorative object, for example, a glass object, a cut gemstone, or a natural crystal structure, such as a mineral, having at least one surface that is coated to give the decorative object an improved appearance. While the decorative object is a gemstone in certain embodiments, the properties (e.g., color) of a wide variety of transparent or translucent substrates can be altered in accordance with the present invention.

Figure 4:
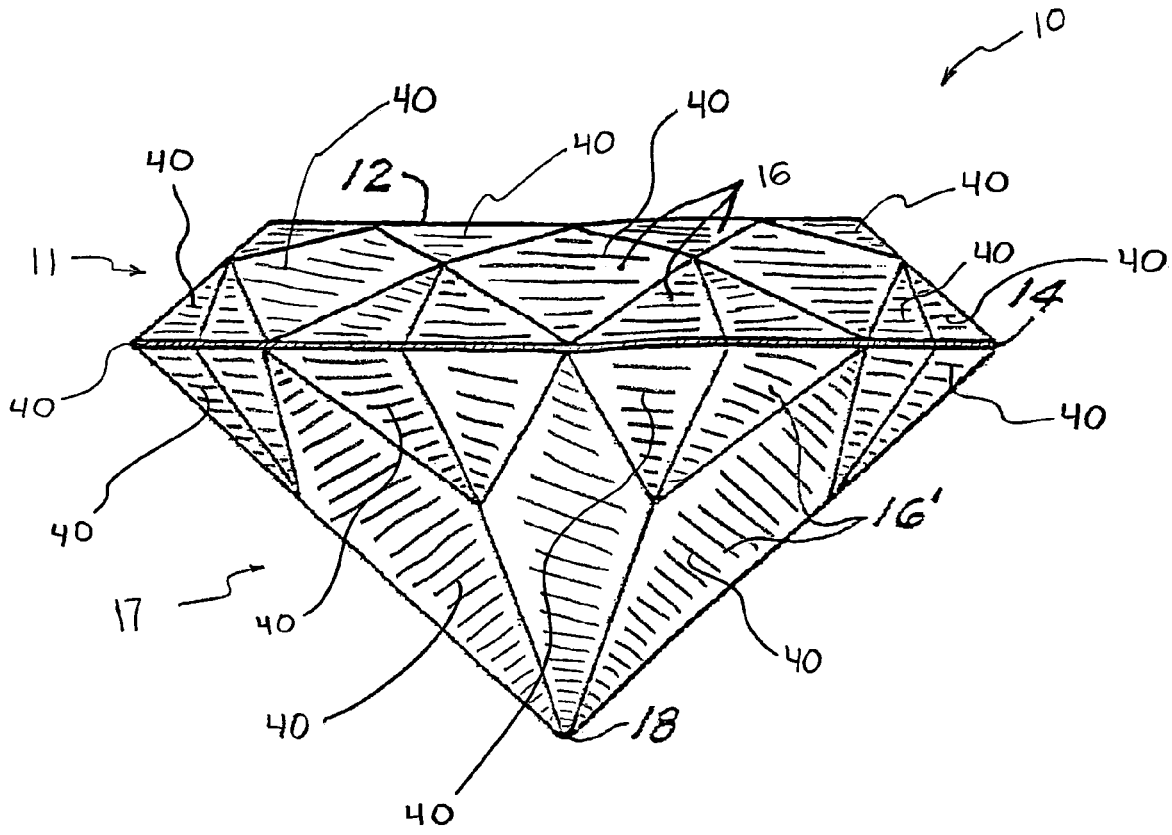
FIG. 4 is a side view of a gemstone having a coating over the entire surface of the gemstone in accordance with certain embodiments of the invention.
Figure 5:
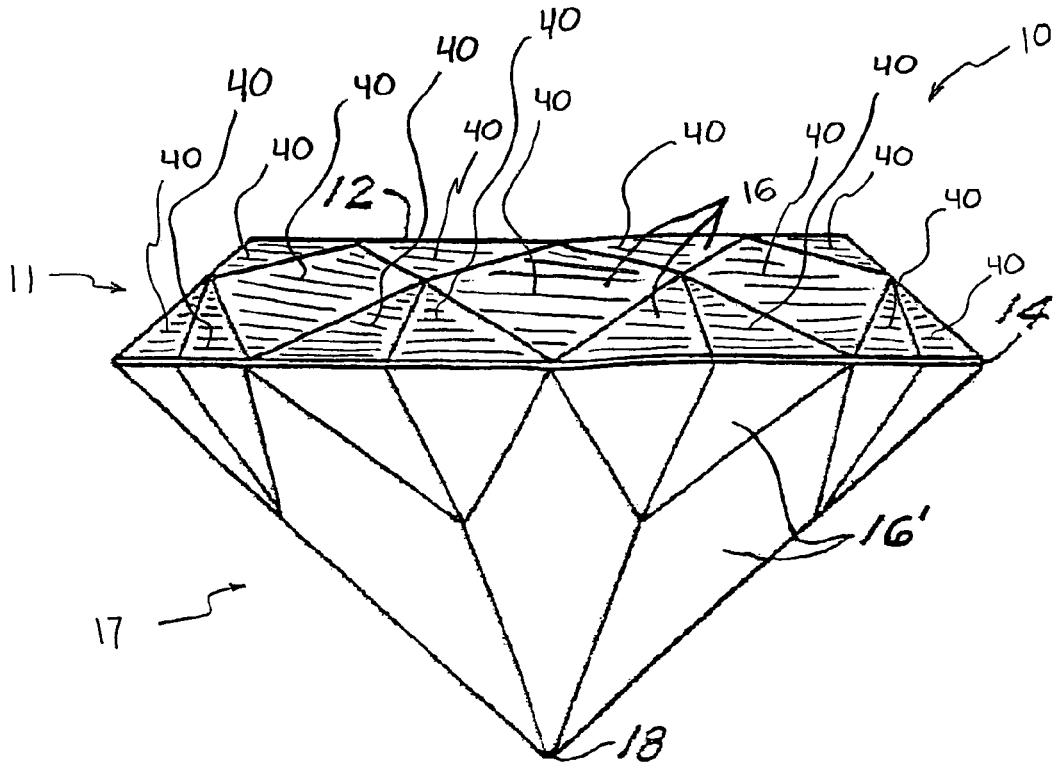
FIG. 5 is a side view of a gemstone carrying a coating on its crown in accordance with certain embodiments of the invention.
Figure 6:
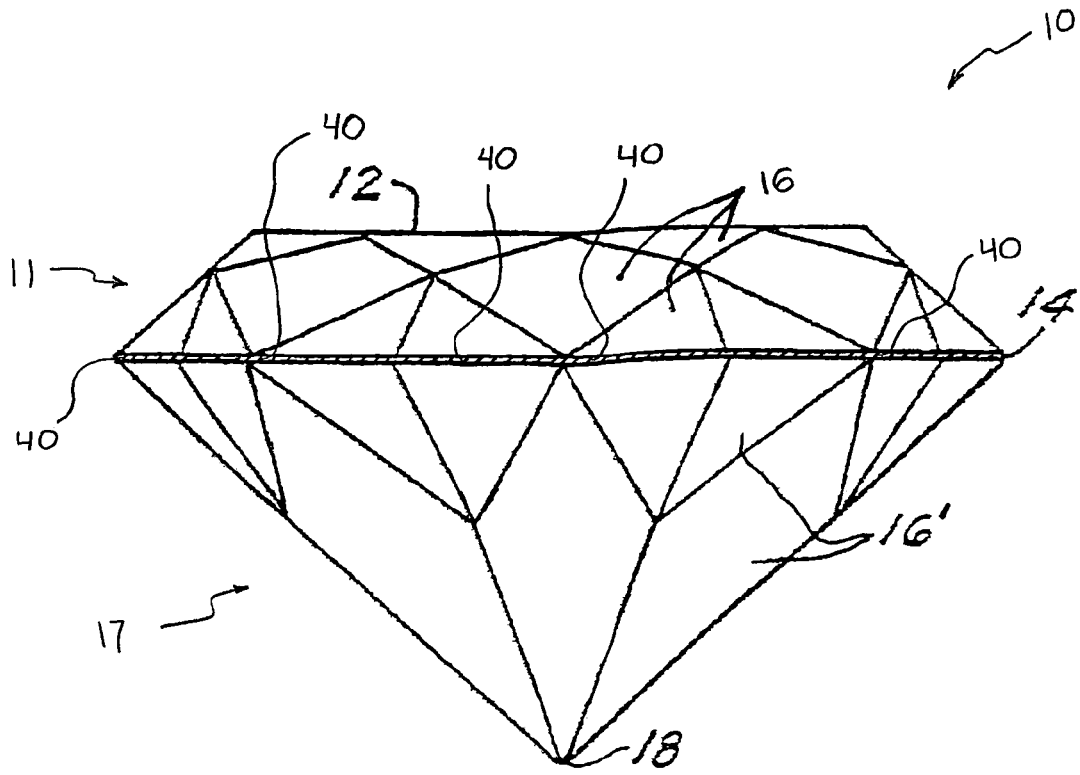
FIG. 6 is a side view of a gemstone carrying a coating on its girdle in accordance with certain embodiments of the invention.

FIG. 1 depicts an embodiment wherein the substrate 10 is a gemstone. The illustrated gemstone 10 is a multifaceted gemstone of the well known "brilliant" cut configuration. The invention, of course, is not limited to cut gemstones, nor is it limited to any particular cut configuration. For example, the gemstone 10 can alternatively be of the well known "step cut" or "Dutch rose cut" configurations, if so desired. The brilliant-cut gemstone of FIG. 1 has a crown 11, a girdle 14, and a pavilion 17. The crown 11 (or "front" or "top") of the gemstone 10 defines a table 12 at its top surface and has a plurality of facets 16. The pavilion 17 (or "back" or "underside") of the gemstone defines a culet 18 at its bottom tip and also has a plurality of facets 16'. Extending between the crown 11 and pavilion 17 of the gemstone 10 is the girdle 14. The embodiment of FIG. 1 involves a coating 40 applied only to the pavilion 17 of the gemstone 10, although this is by no means a requirement. For example, the entire gemstone 10 can alternatively be coated (i.e., the coating 40 can be applied over the entire exterior surface area of the stone 10), as shown in FIG. 4. In another embodiment (not shown), only the crown 11 (including the table 12) of a gemstone 10 is coated as shown in FIG. 5. In still another embodiment, only the girdle 14 of a gemstone 10 is coated, as shown in FIG. 6. Many variations of this nature are anticipated. In any event, the body of the coated object preferably is substantially free of diffused material from the coating. That is, the coating 40 on the decorative object preferably is a discrete coating carried on the surface of the object. Thus, the coating 40 is preferably applied, and optionally heat treated, under conditions that do not cause coating material to diffuse substantially into the substrate, as described below.

Figure 2:
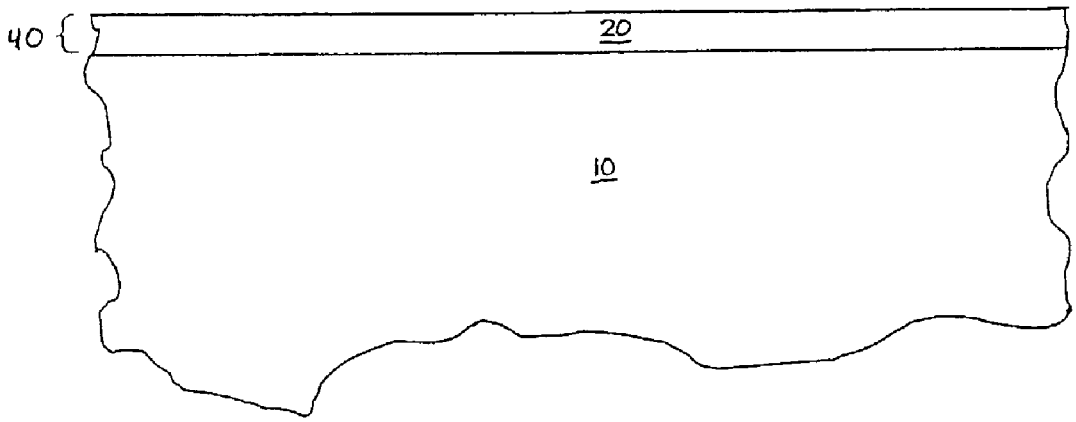
FIG. 2 is a schematic cross-section-view of a coating in accordance with certain embodiments of the invention.
Figure 3:
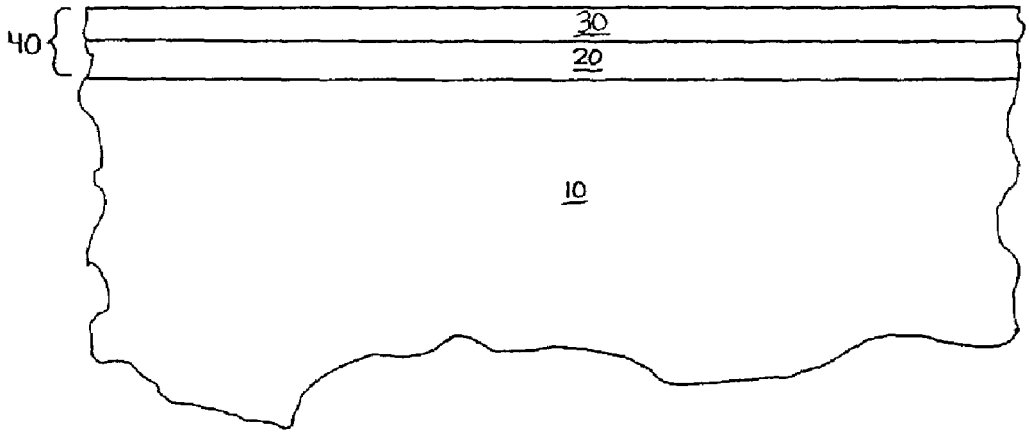
FIG. 3 is a schematic cross sectional view of another coating in accordance with certain embodiments of the invention.

FIGS. 2 and 3 depict a substrate 10 bearing a coating 40 in accordance with certain embodiments of the invention. The total thickness of the coating 40 is very thin. Generally, the coating thickness (all thicknesses described herein are physical thicknesses unless specified as being optical thicknesses) is on the order of about 100 Å to about 50,000 Å, and preferably is between about 100 Å and about 15,000 Å. Since the coating is so thin, it is surprising that it 40 produces such desirable color by absorption. Preferably, when the coating 40 is deposited, it 40 comprises film 20 that is highly absorptive of visible radiation (i.e., light). For example, one particular embodiment provides an absorber layer 20 comprising (e.g., consisting essentially of) vanadium oxide. Another embodiment provides an absorber layer 20 comprising (e.g., consisting essentially of) substoichometric titania. A further embodiment provides an absorber layer 20 comprising (e.g., consisting essentially of) superstoichiometric titania. In certain particularly preferred embodiments, the coating 40 includes at least one film layer that comprises both a dielectric carrier material and a dopant (or "colorant") that is highly absorptive of visible radiation. In FIG. 2, the illustrated coating 40 consists of a single absorbing layer 20. Preferably, this film layer 20 has a different composition (and a different refractive index) than the substrate 10. In the embodiment of FIG. 2, the absorbing layer 20 is deposited directly upon the substrate 10. However, this is not the case in all embodiments of the invention, as described below.

The dielectric carrier material can comprise any desired dielectric material. The term "dielectric" is used herein to refer to any non-metallic (i.e., neither a pure metal nor a metal alloy) compound that includes any one or more metals. Included in this definition would be any metal oxide, metal nitride, metal carbide, metal sulfide, metal boride, etc., and any combination thereof (e.g., an oxynitride). Further, the term "metal" should be understood to include all metals and semi-metals (i.e., metalloids).

In certain embodiments, the transparent dielectric carrier material comprises an oxide, a nitride, and/or an oxynitride. For example, the carrier material can advantageously comprise an oxide, a nitride, and/or an oxynitride of a metal selected from the group consisting of titanium, zirconium, silicon, tantalum, niobium, aluminum, tungsten, tin, cerium, and germanium. These embodiments are particularly desirable.

As noted above, the dopant preferably comprises material that is highly absorptive of visible radiation. For example, the highly absorptive dopant can advantageously comprise a metal selected from the group consisting of chromium, cobalt, cerium, vanadium, praseodymium, manganese, iron, nickel, copper, ruthenium, rhodium, silver, gold, and platinum. Thus, the dopant may be present in the film 20 in the form of a metal or metal alloy. Alternatively, the dopant may be present in the film as an oxide, nitride, boride, or another compound, which is preferably highly absorptive of visible radiation. In one particular embodiment, the absorber layer 20 comprises (e.g., consists essentially of) silicon oxide, cobalt oxide, titanium oxide, and cesium oxide. In another embodiment, the absorber layer 20 comprises (e.g., consists essentially of) silicon oxide and silver. In still another embodiment, the absorber layer 20 comprises (e.g., consists essentially of) titanium oxide and vanadium oxide. In certain preferred embodiments, the dielectric carrier material is a compound comprising a first metal, the highly absorptive dopant comprises a second metal, and these first and second metals are different.

The absorbing layer 20 (or the "absorber layer" or the "high absorption layer") preferably has an optical thickness of less than about one quarter of a wavelength of visible radiation (i.e., light). Visible radiation occurs in the wavelength range of between about 380 nm and about 780 nm. Thus, the high absorption layer preferably has an optical thickness of less than about 950 Å. In certain embodiments, the high absorption layer has an optical thickness of between about 200 Å and about 950 Å. As is well known in the present art, optical thickness is the product of a film's physical thickness and its refractive index.

In certain preferred embodiments, the high absorption layer 20 is applied directly to the substrate 10. For example, FIGS. 2 and 3 depict embodiments of this nature. It will be understood, however, that the invention provides alternate embodiments wherein one or more films are positioned between the substrate 10 and the high absorption layer 20. In the embodiment of FIG. 2, the coating 40 consists of a single film layer 20 (i.e., the high absorption layer). In the embodiment of FIG. 3, the coating 40 consists of two layers 20, 30, optionally having one or more films (not shown) positioned between these layers 20, 30. In certain embodiments (not shown), the coating 40 comprises a surprisingly large number (e.g., more than 20 layers, more than 100 layers, etc.) of film layers. Thus, in embodiments where the absorber layer 20 is applied directly to the substrate 10, it can be appreciated that one 30 or more films can be provided over the absorber layer 20 (which in such embodiments may be applied directly to the substrate or over one or more films (not shown)). Regardless of its particular layer structure, the coating 40 imparts in the decorative object 10 uniform body color that is (i.e., appears) substantially constant or "solid" (i.e., does not substantially change in hue) at different angles of observation (i.e., at different viewing angles/when moving the decorative object relative to the observer or visa versa).

The coating 40 may produce some optical interference phenomenon. The coating 40 typically has a different refractive index than the decorative object 10. As a consequence, some optical interference is produced. This may impart a slight dichroic effect in the coated decorative object. The coating 40, though, does not have a substantial dichroic appearance (i.e., it has a substantially non-dichroic appearance), and thus has a very natural and "real" appearance. Thus, one aspect of the invention provides a decorative object bearing a coating 40 that imparts (through absorption of visible radiation passing through the coating 40) in the decorative object a solid body color that appears substantially constant at different angles of observation, wherein the thus coated decorative object has a substantially non-dichroic appearance).

As noted above, the coating 40 in certain embodiments comprises a second film layer 30 deposited over the high absorption film layer 20. In these embodiments, the coating 40 is preferably provided at an optical thickness of less than about one quarter of a wavelength of visible radiation (as described above).

In embodiments like that shown in FIG. 3, the second layer 30 can comprise any of the materials described above with reference to the film layer 20. For example, this layer 30 can comprise any of a variety of transparent, translucent, or opaque materials. Examples includes metals, metal oxides, nitrides, sulfides, and transparent carbon. Titanium, aluminum, boron, carbon, zirconium, hafnium, niobium, vanadium, tungsten, chromium, and zinc are representative useful metals. Particularly preferred are titanium and titanium oxides, and, zirconium and zirconium oxides. The coating material can be amorphous or crystalline and can be composed of materials generally thought to be opaque but in very thin films are at least translucent. In certain embodiments, the second layer 30 comprises a desirable mechanically and chemically durable material, such as a film comprising titanium (e.g., titanium dioxide, titanium nitride, etc.) and/or silicon (e.g., silicon dioxide, silicon nitride, etc.).

As noted above, certain embodiments provide a gemstone 10 having coating 40 only on a pavilion 17 of the gemstone 10. Faceted gems are usually set in jewelry with the pavilion 17 protected by a setting (not shown). In many cases, the setting protects the coating 40 from mechanical abrasion, which can occur when the gemstone 10 is worn as an ornament. Coating the pavilion 17 selectively is also advantageous in that it results in a highly uniform color being imparted in the gemstone 10. The viewing angle is typically limited by the setting to those angles viewable through the top of the stone, resulting in a particularly natural appearance of the stone 10 since the effect of the coating 40 is viewed through the stone 10. This gives the appearance of the entire stone 10 having the color imparted by the coating 40. Since the top of the gemstone 10 is uncoated in these embodiments, the "luster" or light reflected off the outer surface of the stone remains the same as the original stone since the reflection characteristics of the top of the stone are unchanged. This is especially desirable.

The coating can be applied by various methods. All of these methods employ low temperatures so as not to affect the gemstone or decorative object other than to coat its surface. For purposes of this application, low temperatures are defined as those not substantially affecting the chemical structure of the gemstone or decorative object, such as by melting, decomposing, chemically activating it, diffusing into it, etc. The low temperature is preferably less than about 200 degrees Celsius. Thus, the substrate 10 is preferably maintained at a temperature of less than about 200 degrees Celsius during coating. The coating can thus be formed to have a non-splotchy, uniform appearance. Representative low temperature vapor-coating techniques include:

(1) Sputtering applies energy from a plasma (e.g., argon) to a cathodic target material so as to eject energetic ions, atoms, and/or molecules, a portion of which then land upon and coat a nearby substrate. The ejected material may be produced by positive ions striking the cathodic target to eject the target material. Radio-frequency or direct current glow discharges also directly produce reactive ions, atoms, and/or molecules for coating a substrate. In the present invention, the substrate may be a gemstone and its pavilion can be coated by ions, atoms, and/or molecules sputtered from the bombarded target material. This method is generally employed at subatmospheric pressures and preferably at a near vacuum. In the present invention, the preferred method for coating a surface of a substrate is by reactive sputtering. For this technique, oxygen or other reactive gas (e.g., nitrogen) is added to an inert gas to react with the sputtered target material. When applying plural coats of material on the substrate, the same low temperature coating technique may be applied with a different coating material or by a different coating technique. In the situation of reactive sputtering, a different target and/or a different reaction gas may be used without moving the substrate being coated. The coating 40 can also be deposited by co-sputtering (e.g., reactively) two targets of different material by selecting the respective materials of the targets according to the material desired for the deposited film.

(2) Chemical vapor deposition (CVD) and physical vapor deposition (PVD) involve the passage of an active or reactive gas in an inert carrier gas across the surface of the decorative object being coated. The reaction gas then decomposes or is caused to react with components in the gas or the substrate to coat the substrate.

(3) Arc Source deposition is the use of direct current to ionize coating materials for coating a substrate. At lower currents, a glow discharge is produced and also may be used. The arc may be directly applied by making the substrate a workpiece anode. Alternatively, a plasma jet of excited gases may be applied to the surface of the substrate or gemstone to coat it. For such a coating method, the atmosphere is carefully controlled and usually involves subatmospheric pressure. The gas injected around the are to be converted into a plasma may be inert, neutral, oxidizing, or reducing, depending on the particular coating desired on the substrate. In evaporation, two or more sources of particles are aimed at a heated substrate, which in a preferred embodiment is the pavilion of the gemstone. In ultrahigh vacuums, a molecular beam epitaxy apparatus may form a single crystal coating layer on the substrate.

(4) Low pressure chemical vapor deposition (LPCVD) involves the placing of the substrate in a vacuum chamber along with the coating material. The coating material is heated, typically by being placed in a heated vessel within the vacuum chamber. Under low pressure, the chemical vapor is evaporated and deposited as a thin film layer on the substrate.

In each of these vapor-coating techniques, the thickness of the coating can be changed easily by modifying certain deposition conditions. For example, when the layer is applied by sputtering, the duration, power, deposition atmosphere, and material being sputtered determine the thickness of the deposited film. When coating the substrate by sputtering, the treatment time will vary depending on the particular apparatus, but generally ranges from about 5 minutes to about 30 minutes. A particularly thin film can even be applied in a matter of seconds.

Adjusting the thickness of the coating directly affects the color and other optical properties of the gemstone or other decorative object. Thus, the method can be used to apply different gem thicknesses to different parts of the gemstone yielding different hues, or different shades of the same hue, within the same coated gemstone.

Figure 7:
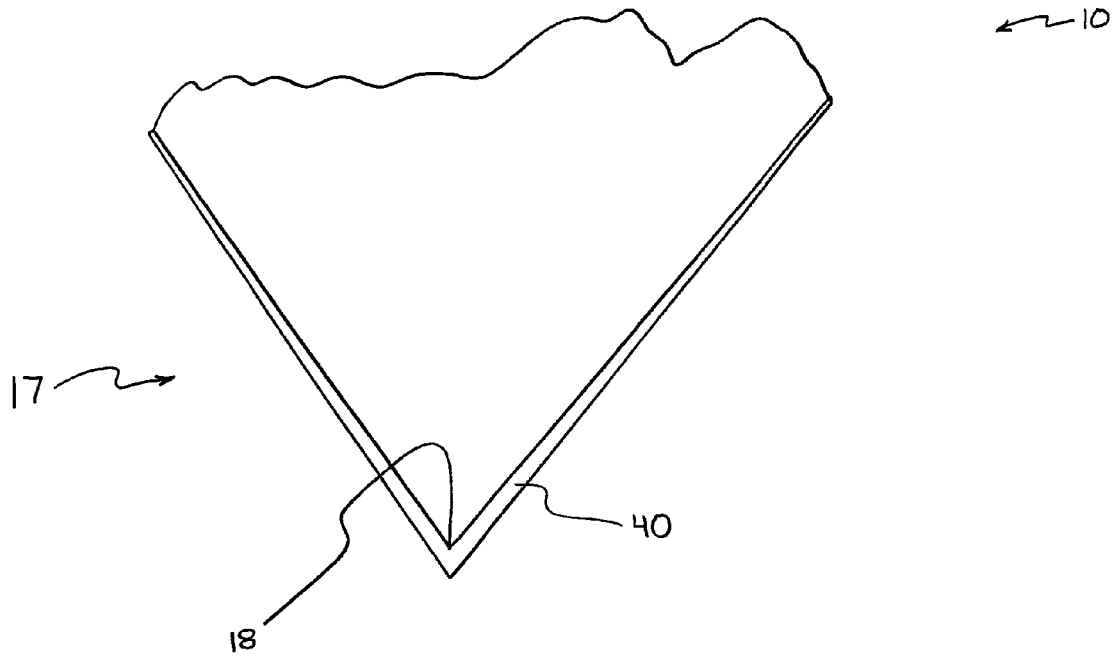
FIG. 7 is a side view of a gemstone carrying a coating that has a maximum thickness adjacent a culet of the gemstone and that becomes thinner with increasing distance from the culet in accordance with certain embodiments of the invention.

In one method, a plurality of gemstones are provided. The stones are positioned in a sputtering chamber adapted to apply the desired coating 40. In one embodiment of this method, the stones are positioned within the chamber in a configuration wherein the pavilion of each stone is oriented toward the cathode(s)/target(s) in the chamber. The cathode (s)/target(s) is then energized, such that material from the target(s) is sputtered onto the pavilions of the gemstones. By sputtering the target(s) while maintaining the gemstones in this configuration, a particularly desirable sputtered coating can be deposited upon the gemstones. In particular, this method has been found to yield a coating on the pavilion of each gemstone that has its greatest (i.e., maximum) thickness adjacent the culet and becomes thinner with increasing distance from the culet, as shown in FIG. 7. This deposition method, and the resulting coating, is particularly advantageous since stronger light (light striking the top of the stone at angles near normal to the top surface of the stone) tends to pass through the thicker coating area (adjacent the culet), while weaker light (light striking the top of the stone at angles further away from normal to the top surface of the stone) tends to pass through the thinner coating areas (further from the culet). This improves the coloration of the gemstone, due to the greater path length of strong light through the absorptive coating 40.

The invention also provides methods of heat treating coated gemstones and other coated decorative objects. In some embodiments of this nature, the method comprises providing a decorative object having at least one surface bearing a thin film coating. The method further comprises heat treating the coated object to improve the color and/or other properties of the object. In these embodiments, the thin film coating can be of a variety of different types. For example, the heat-treated coating can be one of the coatings described herein (e.g., a sputtered coating, optionally having a thickness of less than 50,000 Å and preferably less than 15,000 Å). However, the invention extends to performing the present methods of heat treating a coated decorative object regardless of the particular type of coating that is born on the decorative object.

The coated decorative object can be heat treated to enhance its properties (e.g., color, durability, etc.) using essentially any oven adapted to reach the desired heat-treatment temperature. Preferably, the oven is adapted to reach and maintain elevated temperatures of at least (e.g., greater than) about 200 degrees Celsius. More preferably, the oven is adapted to reach temperatures of between about 300 and about 600 degrees Celsius (e.g., at least about 400–450 degrees Celsius). In many cases, the oven is capable of reaching and maintaining higher elevated temperatures (e.g., at least up to about 700, 900, or 1150 degrees Celsius). Thus, it can be appreciated that the method may comprise positioning the coated object in an oven, and operating the oven so as to subject the coated object to a desired heat-treatment process.

The coated object can be subjected to a variety of heat-treatment processes. Preferably, the coated object is subjected to a heat-treatment process wherein the maximum temperature is less than that at which there occurs substantial diffusion of material from the coating into the decorative object. Thus, the present heat treatment preferably does not cause coating material to diffuse substantially into the decorative object. Surprisingly, though, the described heat treatment causes a great increase, or a great change, in the color of the coated object. For example, a sputtered film may not impart substantial color, or the desired color, in a gemstone or other decorative object prior to being heat treated, whereas following the described heat treatment the coated decorative object exhibits a great increase, or a great change, in color. It is surmised that the heat treatment advantageously causes the coating material to crystallize (and/or causes existing crystals to exhibit further growth), and thereby improves the intensity of the color (i.e., increases the chroma) and/or reaches a particular hue.

Preferably, the coated object is exposed to an elevated temperature of at least about 200 degrees Celsius, more preferably between about 300–600 degrees Celsius, and optimally between about 400–450 degrees Celsius. Preferably, the heat treatment (e.g., which typically begins with the coated object at room temperature) involves exposing the coated object to an elevated temperature, and raising this temperature to a desired maximum temperature (which is preferably at least about 200 degrees Celsius, more preferably between about 300–600 degrees Celsius, and optimally between about 400–450 degrees Celsius) in a period of between about 1–8 hours, and then decreasing this temperature (e.g., typically back down to room temperature) in a period of between about 1–8 hours. In one particular method, there is provided a gem (e.g., topaz, quartz, etc.) bearing a coating of titanium oxide and vanadium oxide (e.g., a 50–50 mixture). The thus coated gem is heat treated to (e.g., in an oven adapted to reach) a temperature of about 450 degrees Celsius in about 1–8 hours. The heat is then ramped back down to allow the coated gem to cool to room temperature over about 1–8 hours. Given the relatively slow heat-up time, the coated gem is heat treated without breakage. By contrast, an extremely fast heat-up time (e.g., heating a coated gem to such temperature using a torch, as may be done in about 30 seconds) is preferably avoided so as to prevent unacceptable gem breakage.

The coated decorative object desirably is subjected to a heat-treatment process wherein the maximum temperature does not exceed about 1150 degrees Celsius, preferably does not exceed about 900 degrees Celsius, more preferably does not exceed about 700 degrees Celsius, and perhaps optimally is between about 300 and about 600 degrees Celsius (e.g., 400 degrees Celsius or 450 degrees Celsius).

Some of the heat-treatment methods described above comprise coating at least one surface of the decorative object before heat treating the coated object. In these embodiments, the decorative object can be coated using a variety of coating methods. In certain embodiments of this nature, the method comprises vapor coating the decorative object before heat treating the thus coated object. For example, the method may comprise sputter coating the decorative object (e.g., to a coating 40 thickness of less than 50,000 Å, preferably less than 15,000 Å) before heat treating the coated object. As noted above, the decorative object is preferably coated while being maintained at a low temperature of less than about 200 degrees Celsius.

In certain embodiments, the decorative object is a gemstone. Thus, the method may comprise providing a gemstone having at least one surface carrying a thin film coating. The method comprises heating such a coated gemstone to an elevated temperature of at least (e.g., greater than) about 200 degrees Celsius. Preferably, the coated stone is heated to a maximum temperature below that at which there occurs substantial diffusion of material from the coating into the gemstone. In one such method, the coated gemstone is heated to a maximum temperature not exceeding about 1150 degrees Celsius, preferably not exceeding about 900 degrees Celsius, more preferably not exceeding about 700 degrees Celsius, and perhaps optimally being between about 300 and about 600 degrees Celsius (e.g., about 400 degrees Celsius or about 450 degrees Celsius). In some cases, the coated stone is exposed to temperatures exceeding these ranges, but not for so long as to cause substantial diffusion of coating material into the gemstone.

EXAMPLE 1

Faceted white topaz gemstones were cleaned with a 5% solution of Dawn dishwashing detergent in an ultrasonic cleaner for 5 minutes and rinsed with deionized water. The parts were dried and loaded into a sputtering machine with titanium and vanadium targets. Argon and oxygen gas were introduced into the chamber and the topaz gemstones were coated on the pavilion by reactive co-sputtering. The parts were rotated alternately under the titanium and vanadium targets to build up many (more than 20 alternating layers of titania and vanadium oxide). The argon pressure was 10 millitorr and the oxygen pressure was adjusted to maintain the titanium target sputtering a fully oxidized mode. Approximately 25% by volume of oxygen was used compared to the argon. (Insufficient oxygen gives an opaque metallic deposit). A film of approximately 50% Titania and 50% vanadium oxide was produced. The film thickness was approximately 0.3 microns thick. The film was transparent and very light gray in color. The topaz gemstones were then heated in an oven to 450 degrees Celsius over about 1 hour. After reaching 450 degrees Celsius, the oven was turned off and allowed to cool. This required about 1.5 hours. The gemstone color after heat treatment was a uniform yellow body color.

EXAMPLE 2

Faceted white topaz gemstones were cleaned with a 5% solution of Dawn dishwashing detergent in an ultrasonic cleaner for 5 minutes and rinsed with deionized water. The parts were dried and loaded into a sputtering machine with silicon and cobalt targets. The gemstones were sputtered by rotating underneath the silicon and cobalt targets to deposit many (more than 100) layers of silica and cobalt oxide. Argon and oxygen gas were introduced into the chamber and the topaz gemstones were coated on the pavilion by reactive sputtering. The argon pressure was 15 millitorr and the oxygen pressure was adjusted to maintain the silicon target sputtering a fully oxidized mode. The silicon target was powered by a periodic voltage reversal pulsed DC power supply to minimize arcing caused by silica buildup on the target. Approximately 20% by volume of oxygen was used compared to the argon. (Insufficient oxygen gives a dark yellow brown color due to metallic silicon). A film of approximately 90% silica and 10% cobalt oxide was produced. The film thickness was approximately 2.5 microns thick. The film was transparent and colorless. The topaz gemstones were then heated in an oven to 450 degrees Celsius over about 1 hour. After reaching 450 degrees Celsius, the oven was turned off and allowed to cool. This required about 1.5 hours. The gemstone color after heat treatment was a uniform light blue body color.

While preferred embodiments of the invention have been described, it should be understood that numerous changes, adaptations, and modifications can be made therein without departing from the spirit of the invention and the scope of the appended claims. All references mentioned in this application are incorporated by reference.

What is claimed is:

1. A gemstone having a body with a pavilion bearing a coating that serves as an absorber of certain visible radiation frequencies to provide color so as to impart in the gemstone a desired uniform body color that does not substantially change in hue when viewed at different angles of observation, wherein said coating is a discrete coating on the gemstone such that the body of the gemstone is substantially free of diffused material from said coating, said coating being born only on the pavilion of the gemstone, wherein the pavilion of the gemstone defines a culet and said coating has a thickness that is greatest adjacent the culet and becomes generally thinner with increasing distance from the culet, said coating including a high absorption layer of film that is highly absorptive of visible radiation such that the desired uniform body color is imparted in the gemstone.

2. The gemstone of claim 1 wherein the high absorption layer comprises both a dielectric carrier material and a dopant that is highly absorptive of visible radiation, wherein the dielectric carrier material is a compound comprising a first metal, and the highly absorptive dopant comprises a second metal, said first and second metals being different.

3. The gemstone of claim 1 wherein the high absorption layer has an optical thickness of less than about 950 Å, optical thickness being determined by multiplying physical thickness and refractive index.

4. The gemstone of claim 1 wherein said coating has an optical thickness of less than about 950 Å, optical thickness being determined by multiplying physical thickness and refractive index.

5. A gemstone having a body with a pavilion bearing a coating that serves as an absorber of certain visible radiation frequencies to provide color so as to impart in the gemstone a desired uniform body color that does not substantially change in hue when viewed at different angles of observation, wherein said coating is a discrete coating on the gemstone such that the body of the gemstone is substantially free of diffused material from said coating, said coating being born only on the pavilion of the gemstone, wherein the pavilion of the gemstone defines a culet and said coating has a thickness that is greatest adjacent the culet and becomes generally thinner with increasing distance from the culet, said coating including a high absorption layer of film that is highly absorptive of visible radiation such that the desired uniform body color is imparted in the gemstone, wherein the high absorption layer has an optical thickness of less than about 950 Å, optical thickness being determined by multiplying physical thickness and refractive index.

* * * * *

UNITED STATES PATENT AND TRADEMARK OFFICE

CERTIFICATE OF CORRECTION

PATENT NO. : 6,997,014 B2
APPLICATION NO. : 10/288401
DATED : February 14, 2006
INVENTOR(S) : Steven F. Starcke, Ronald H. Kearnes and Kevin E. Bennet It is certified that error appears in the above-identified patent and that said Letters Patent is hereby corrected as shown below:

TITLE PAGE, ITEM (75) INVENTORS:

DELETE "Keven E. Bennet", AND
INSERT --Kevin E. Bennet--.

Signed and Sealed this

Sixth Day of March, 2007

JON W. DUDAS
*Director of the United States Patent and Trademark Office*